US008286821B2

(12) United States Patent
Mejia et al.

(10) Patent No.: US 8,286,821 B2
(45) Date of Patent: Oct. 16, 2012

(54) ACCESSORY LID FOR BOTTLE

(76) Inventors: Jennifer M Mejia, Seattle, WA (US); Benjamin A Mejia, Seattle, WA (US)

( * ) Notice: Subject to any disclaimer, the term of this patent is extended or adjusted under 35 U.S.C. 154(b) by 353 days.

(21) Appl. No.: 12/563,163

(22) Filed: Sep. 21, 2009

(65) Prior Publication Data

US 2011/0036803 A1 Feb. 17, 2011

Related U.S. Application Data

(60) Provisional application No. 61/234,314, filed on Aug. 17, 2009.

(51) Int. Cl.
*B65D 25/04* (2006.01)
*B65D 43/00* (2006.01)
*B65D 51/28* (2006.01)

(52) U.S. Cl. ..... 220/521; 215/228

(58) Field of Classification Search ..... 220/521, 220/522, 528; 215/227, 228
See application file for complete search history.

(56) References Cited

U.S. PATENT DOCUMENTS

| | | | | |
|---|---|---|---|---|
| 2,317,882 | A * | 4/1943 | Boesel | 96/148 |
| 3,433,378 | A * | 3/1969 | Ross | 215/6 |
| 7,055,709 | B1 * | 6/2006 | Esau | 215/228 |
| 2003/0000910 | A1 * | 1/2003 | Jang et al. | 215/227 |
| 2008/0000898 | A1 * | 1/2008 | Ramsden | 220/4.26 |
| 2008/0156803 | A1 * | 7/2008 | McClellan et al. | 220/254.1 |

* cited by examiner

*Primary Examiner* — Harry Grosso
(74) *Attorney, Agent, or Firm* — James J. Ruttler; Michael Gibbons

(57) ABSTRACT

This invention relates generally to mechanics, and more specifically, to an accessory lid for a bottle. In one embodiment, the invention includes an accessory lid having a base configured to removably couple with a bottle; a cover configured to removably couple with the base; and an accessory compartment disposed therein. In another embodiment, the invention includes an accessory lid having a base configured to removably couple with a bottle; and an accessory compartment disposed therein, wherein the base is configured to removably couple with an existing bottle cover of the bottle. In a further embodiment, the invention includes a bottle having a base configured to removably couple with the bottle; a cover configured to removably couple with the base; and an accessory compartment disposed therein.

19 Claims, 7 Drawing Sheets

ACCESSORY LID FOR BOTTLE

PRIORITY CLAIM

This application claims the benefit of U.S. provisional patent application Ser. No. 61/234,314 filed Aug. 17, 2009 (our ref. MEJA-1-1001). The foregoing application is incorporated by reference in its entirety as if fully set forth herein.

FIELD OF THE INVENTION

This invention relates generally to mechanics, and more specifically, to an accessory lid for a bottle.

SUMMARY

This invention relates generally to mechanics, and more specifically, to an accessory lid for a bottle. In one embodiment, the invention includes an accessory lid having a base configured to removably couple with a bottle; a cover configured to removably couple with the base; and an accessory compartment disposed therein. In another embodiment, the invention includes an accessory lid having a base configured to removably couple with a bottle; and an accessory compartment disposed therein, wherein the base is configured to removably couple with an existing bottle cover of the bottle. In a further embodiment, the invention includes a bottle having a base configured to removably couple with the bottle; a cover configured to removably couple with the base; and an accessory compartment disposed therein.

BRIEF DESCRIPTION OF THE DRAWINGS

Embodiments of the present invention are described in detail below with reference to the following drawings.

DETAILED DESCRIPTION

This invention relates generally to mechanics, and more specifically, to an accessory lid for a bottle. Specific details of certain embodiments of the invention are set forth in the following description and in FIGS. 1-16 to provide a thorough understanding of such embodiments. The present invention may have additional embodiments, may be practiced without one or more of the details described for any particular described embodiment, or may have any detail described for one particular embodiment practiced with any other detail described for another embodiment.

Figure 1:
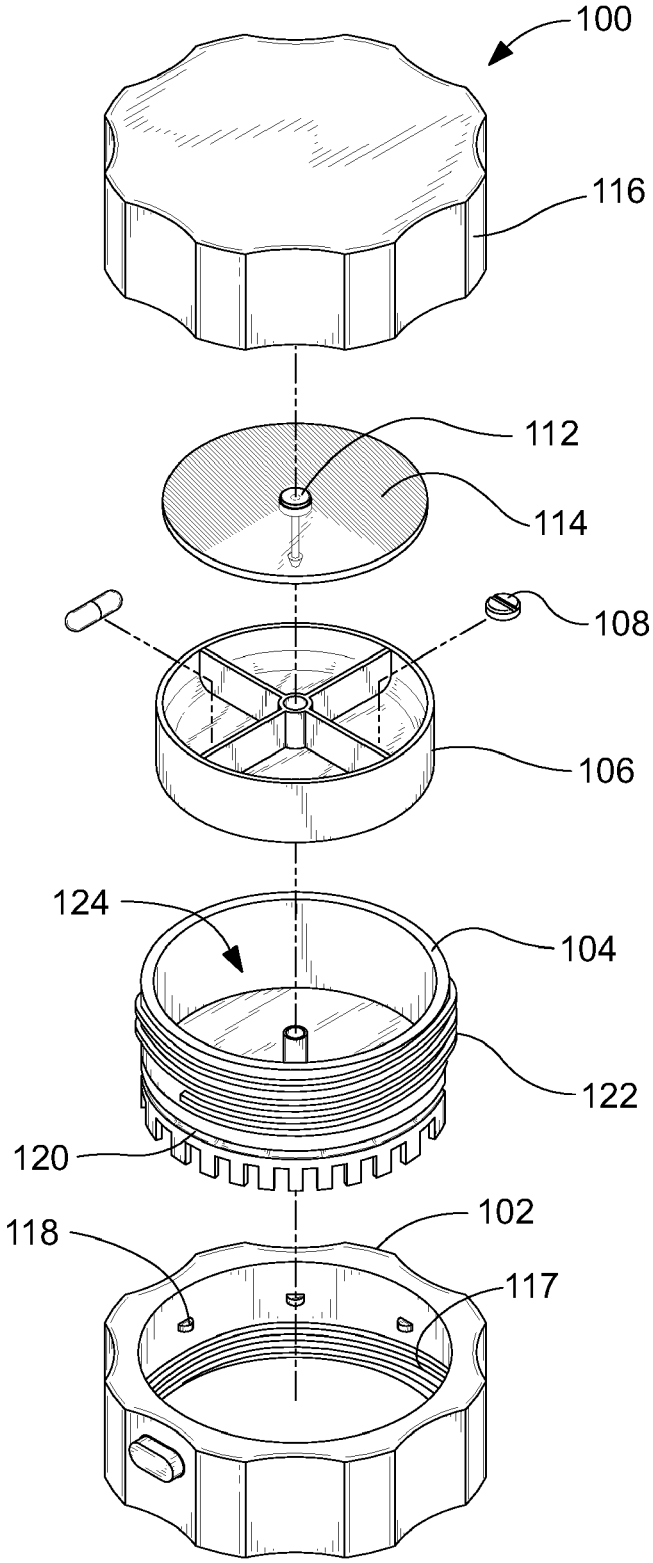
FIG. 1 is an exploded view of an accessory lid for a bottle, in accordance with an embodiment of the invention.

FIG. 1 is an exploded view of an accessory lid for a bottle, in accordance with an embodiment of the invention. In some embodiments, accessory lid 100 includes a base 102, a base insert 104, an accessory compartment 106, an accessory compartment cover 114, a fastener 112, and a cover 116.

In some embodiments, the base 102 includes internal threads 117 for removably receiving bottle threads 604 of a bottle 602 (FIGS. 6 and 7) and one or more bearings 118 for securing the base insert 104 therein. The base insert 104 is rotatably disposed within the base 102 with the one or more bearings 118 being received by channel 120 of the base insert 104. The base insert 104 includes external threads 122 for receiving threads of the cover 116 (not visible) and an internal cavity 124 for removably receiving the accessory compartment 106. The accessory compartment 106 is removably insertable within the base insert 104 and includes one or more compartments 302 (FIG. 3) for receiving one or more accessories 108. The accessory compartment cover 114 is removably disposed on the accessory compartment 106 and secured thereon using the fastener 112. The cover 116 includes internal threads (not visible) for removable securing to the base insert 104. Accordingly, the accessory lid 100 is configurable to removably secure to the bottle 602 and conveniently store the one or more accessories 108 therein.

In some embodiments, the accessory lid 100 includes fewer or greater components. For example, the base 102 and the base insert 104 can be combined into a single component. Alternatively, the base 102, the base insert 104, and the accessory compartment 106 can be combined into a single component. Further, the accessory compartment 106 and the base insert 104 can be combined into a single component. Alternatively, the accessory compartment cover 114 can be omitted. In some embodiments, any of the accessory lid 100 components are linked using a string, thread, ribbon, hose, line, tube, chain, strap, or using another similar mechanism. In some embodiments, the accessory lid 100 and any of its components define different shapes, such as cubes, pyramids, cylinders, or other similar uniform or non-uniform shapes. In some embodiments, the accessory lid 100 and any of its components are composed of plastic, rubber, glass, wood, metal, synthetic, or other similar material. In some embodiments, the base insert 104 is disposed within the base 102 using a mechanism different from the bearings 118 and the channel 120, such as a snapping mechanism, interlocking threads, or other similar mechanism. In some embodiments, accessory compartment cover 114 is secured on the accessory compartment 106 using a mechanism different from the fastener 112, such as through a friction locking mechanism, a clasp, a band, or some other similar mechanism. In some embodiments, the accessory lid 100 and any of its components include or are sealed using a gasket, plug, or other similar seal. In some embodiments, the accessory lid 100 includes a dispensing mechanism for releasing the one or more accessories 108 on a periodic basis, such as once each day or once every four hours; the dispensing mechanism can otherwise prevent access to the one or more accessories 108. In some embodiments, the one or more accessories include a pill, a tablet, a capsule, a medication, a drink mix, a fiber powder mix, a nutritional powder mix, a neutraceutical, a pharmaceutical, a soup or other food mix, money, a key, a card, or any other similar accessory.

Figure 2:
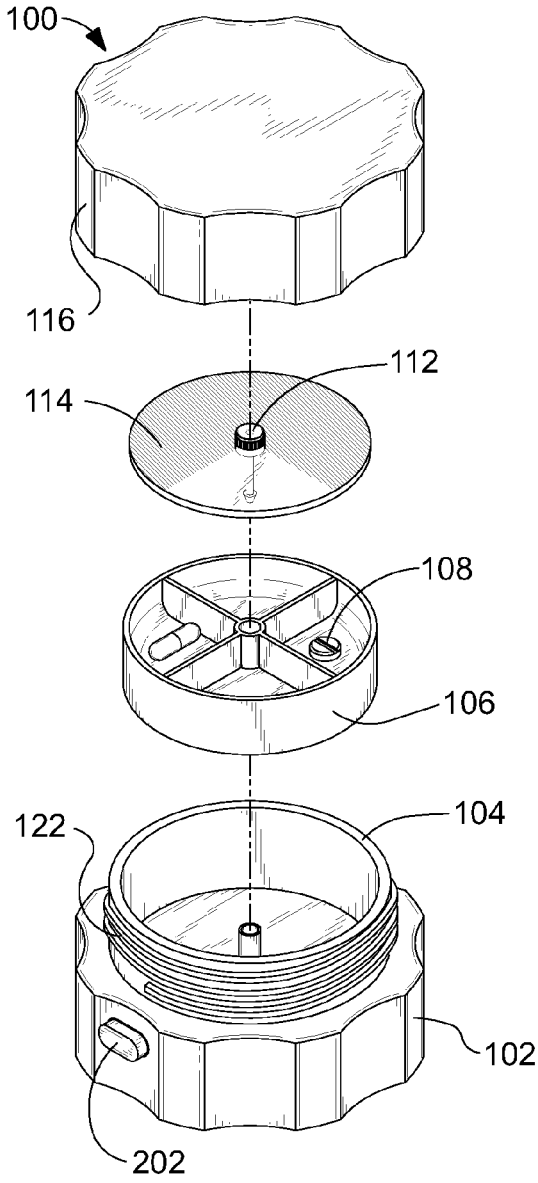
FIG. 2 is an exploded view of an accessory lid having a safety lock for a bottle, in accordance with an embodiment of the invention.

FIG. 2 is an exploded view of an accessory lid having a safety lock for a bottle, in accordance with an embodiment of the invention. In some embodiments, the accessory lid 100 includes the base 102, the base insert 104, the accessory compartment 106, the accessory compartment cover 114, the fastener 112, and the cover 116.

In some embodiments, the base insert 104 is rotatably disposed within the base 102 with the one or more bearings 118 (FIG. 1) being received by the channel 120 (FIG. 1) of the base insert 104. The base 102 includes a safety lock 202 that is operably coupled with the one or more bearings 118. Depression of the safety lock 202 extends the one or more bearings 118 against a wall of the channel 120 and thereby frictionally prevents rotation the base insert 104 and allows removal of the cover 116. Absent force applied to the safety lock 202, the base insert 104 is configured to rotate freely within the base 102 and thereby prevent removal of the cover 116. Accordingly, the safety lock 202 is configurable to protect against unintentional removal of the cover 116 and to prevent access by small children.

Figure 6:
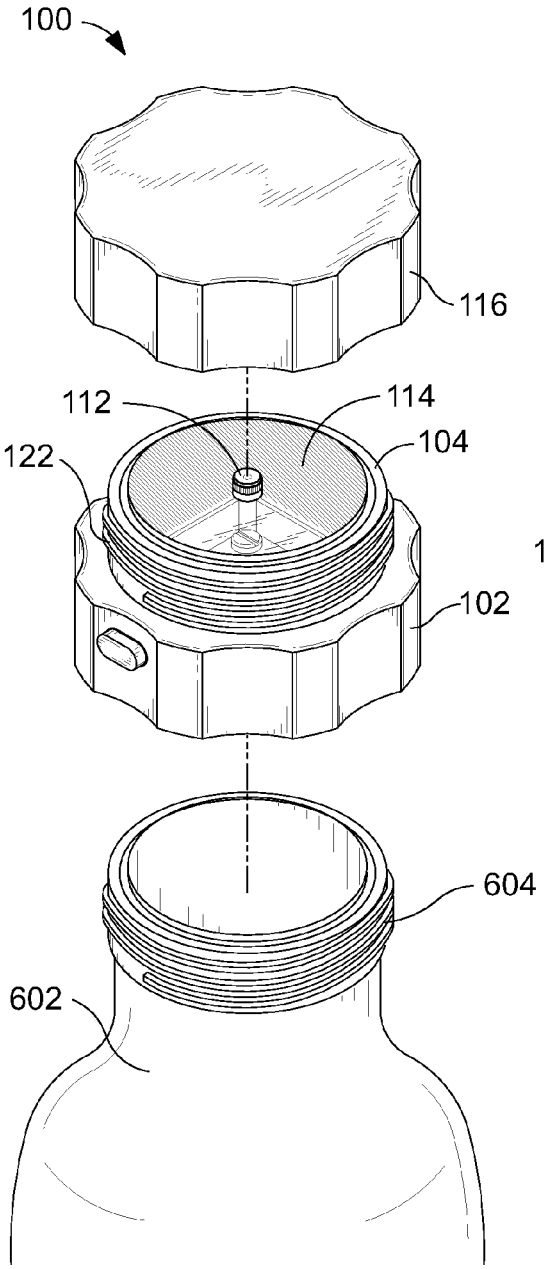
FIG. 6 is an exploded view of an accessory lid having an accessory compartment cover with a bottle, in accordance with an embodiment of the invention.
Figure 7:
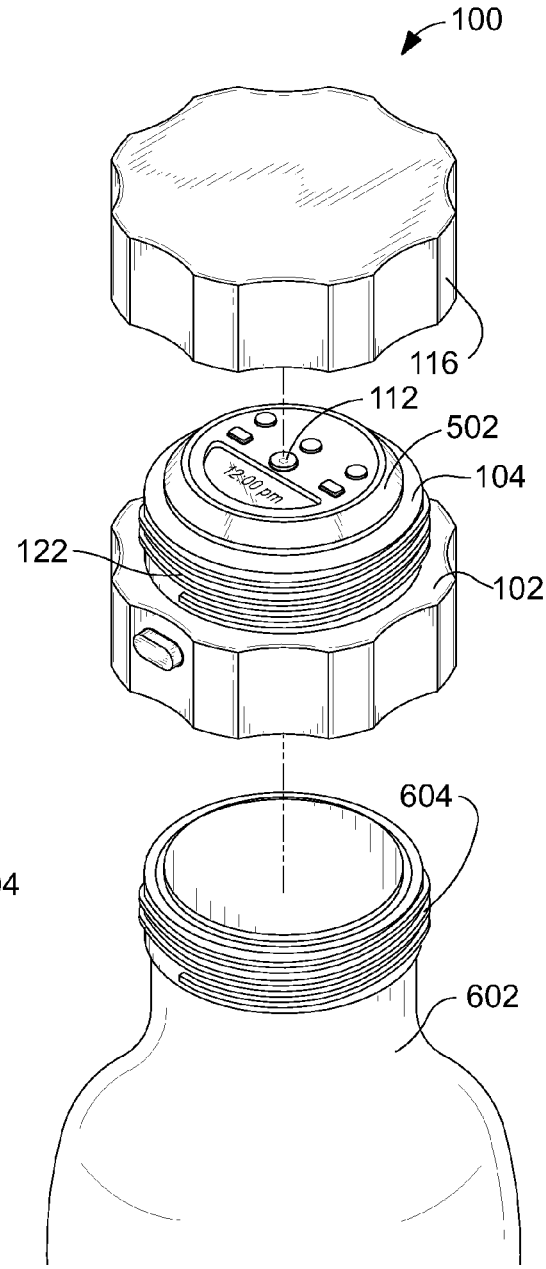
FIG. 7 is an exploded view of an accessory lid having a timepiece with a bottle, in accordance with an embodiment of the invention.

In some embodiments, the safety lock 202 is differently configured to control removal of the cover 116, such as by using any method to provide a child safety lock. In some embodiments, the safety lock 202 is omitted or supplemented with or substituted for an alternative security mechanism, such as a fingerprint reader, a voice recognition device, a retinal scanning device, another biometric device, a key, a keypad for receiving a pin, a receiver for receiving an electrical or wireless signal, a timed release device, or some other similar security mechanism. In some embodiments, a security mechanism is provided to allow removal of the base insert 104 from the base 102, the accessory compartment 106 from the base insert 104, the accessory compartment cover 114 from the accessory compartment, or the base 102 from the bottle 602 (FIGS. 6 and 7). In some embodiments, the accessory lid 100 includes a device for tracking times for which any of the components are removed, such as a time for which the cover 116 is removed from the base 102. In some embodiments, the times are stored for later access or transmitted to a remote monitoring device or application, such as for monitoring consumption of a medication by a child or for tracking consumption of a medication in a health record. In some embodiments, the accessory lid 100 includes an alerting mechanism for providing an alert to a remote monitoring device or application when any of the components of the accessory lid 100 are not removed within a given time frame, such as for alerting a parent that a child has not consumed a medication or for tracking consumption of a medication in a health record. In some embodiments, the accessory lid 100 includes a downloading mechanism for electronically or wirelessly receiving medication schedule information, reminders, alarms, notes, instructions, or other similar content from a computer, mobile device, or server, such as that located at home, a pharmacy, a medical clinic, a hospital, or other similar source.

Figure 3:
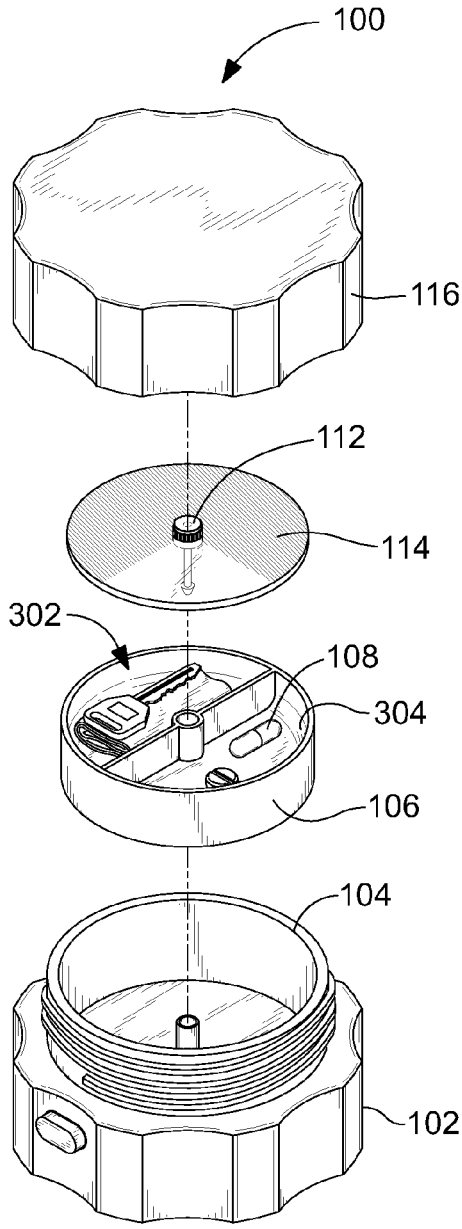
FIG. 3 is an exploded view of an accessory lid having an interchangeable accessory compartment for a bottle, in accordance with an embodiment of the invention.

FIG. 3 is an exploded view of an accessory lid having an interchangeable accessory compartment for a bottle, in accordance with an embodiment of the invention. In some embodiments, the accessory lid 100 includes the base 102, the base insert 104, the accessory compartment 106, the accessory compartment cover 114, the fastener 112, and the cover 116.

In some embodiments, the accessory compartment 106 is removably insertable within the base insert 104 and includes one or more compartments 302 for receiving the one or more accessories 108. The accessory compartment 106 includes an internal angled surface edge 304 to facilitate removal of the one or more accessories 108. The accessory compartment 106 is interchangeable with different accessory compartments having additional, fewer, or differently arranged compartments.

In some embodiments, the accessory compartment 106 includes one compartment 302, two compartments 302, three compartments 302, four compartments 302, five compartments 302, or even more compartments, such as thirty compartments 302. In some embodiments, the accessory compartment 106 includes movable or insertable dividers to alter the size of the one or more compartments 302 or change the number of the one or more compartments 302. In some embodiments, the accessory compartment 106 includes two or more stacked layers of the one or more compartments 302. In some embodiments, the accessory compartment 106 includes a security mechanism to prevent access to any of the one or more compartments 302. In some embodiments, the accessory compartment 106 includes a dispenser to dispense contents of the one or more compartments 302, such as that similar to a birth control dispenser or other medication dispenser. In some embodiments, the accessory compartment 106 is provided by a pharmacy or other retailer as an insert for the accessory lid 100, such as a disposable pouch, packet, pod, or container with a powder mix, a drink mix, a food mix, or a neutraceutical, or a pharmaceutical for consumption. In some embodiments, the accessory compartment 106 is removably securable with the base insert 104. In some embodiments, the accessory compartment 106 is merely disposed within the base insert 104. In some embodiments, the accessory compartment 106 is secured between the accessory compartment cover 114 and the base insert 104.

Figure 4:
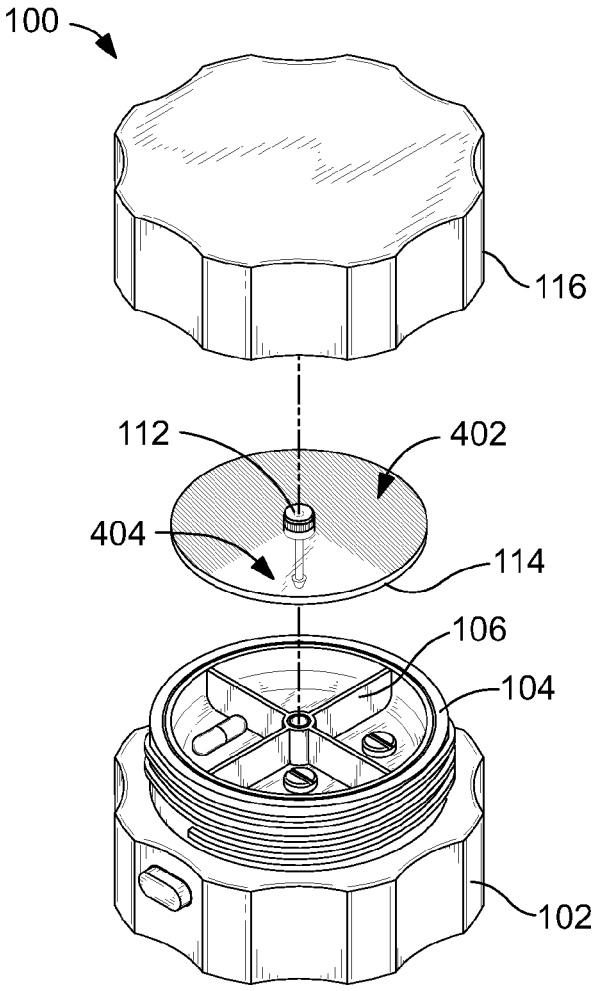
FIG. 4 is an exploded view of an accessory lid having an accessory compartment cover with a transparent portion for a bottle, in accordance with an embodiment of the invention.

FIG. 4 is an exploded view of an accessory lid having an accessory compartment cover with a transparent portion for a bottle, in accordance with an embodiment of the invention. In some embodiments, the accessory lid 100 includes the base 102, the base insert 104, the accessory compartment 106, the accessory compartment cover 114, the fastener 112, and the cover 116.

In some embodiments, the accessory compartment cover 114 is removably disposed on the accessory compartment 106 and secured thereon using the fastener 112. The accessory compartment cover 114 is rotatable about an axis defined by the fastener 112. The accessory compartment cover 114 includes a non-transparent portion 402 and a transparent portion 404. Accordingly, the accessory compartment cover 114 is rotatably securable on the accessory compartment 106 whereby the transparent portion 404 is movable to reveal contents of the accessory compartment 106.

In some embodiments, the accessory compartment cover 114 includes the transparent portion 404 over ¼, ½, ¾, or some other proportion of its surface area. In some embodiments, the accessory compartment cover 114 is entirely transparent or entirely non-transparent. In some embodiments, the accessory compartment cover 114 is positionally fixed relative to the accessory compartment 106. In some embodiments, the accessory compartment cover 114 includes one or more openable flaps or slidable panels to allow access to the accessory compartment 106. In some embodiments, the accessory compartment cover 114 includes one or more openings to allow access to the accessory compartment 106. In some embodiments, the accessory compartment cover 114 is not removable from the accessory compartment 106. In some embodiments, the accessory compartment cover 114 is replaceable with an alternative accessory compartment cover 114.

Figure 5:
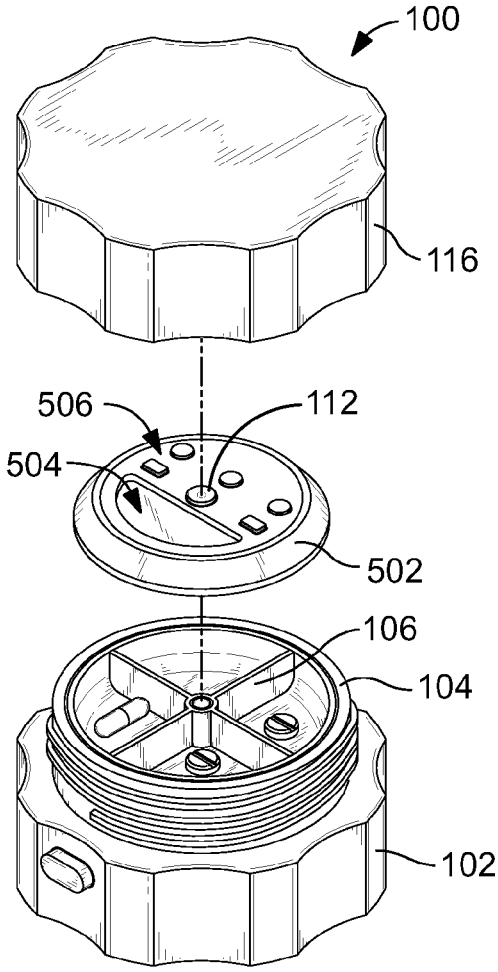
FIG. 5 is an exploded view of an accessory lid having a timepiece for a bottle, in accordance with an embodiment of the invention.

FIG. 5 is an exploded view of an accessory lid having a timepiece for a bottle, in accordance with an embodiment of the invention. In some embodiments, the accessory lid 100 includes the base 102, the base insert 104, the accessory compartment 106, a timepiece 502, the fastener 112, and the cover 116.

In some embodiments, the timepiece 502 is removably disposed on the accessory compartment 106 and secured thereon using the fastener 112. The timepiece 502 includes a display 504 and a user interface 506. The timepiece 502 can be configurable to indicate time, provide an audible or visible alarm, or provide cover to the accessory compartment 106.

In some embodiments, the timepiece 502 is incorporated into the cover 116. In some embodiments, the timepiece 502 is unsecured on the accessory compartment 506. In some embodiments, the timepiece 502 is water-resistant or waterproof. In some embodiments, the timepiece 502 includes time, date, alarm, GPS, navigation, computer, internet, phone, messaging, e-mail, music, consumption tracking/monitoring, or any other similar feature. For example, the timepiece 502 can function to provide an audible, vibratory, or visual reminder on the timepiece 502 or on another device to consume a medication, such as that contained within the accessory compartment 106. In some embodiments, the display 504 or the user interface 506 are digital. In some embodiments, the display 504 or the user interface 506 are physical, such as with hands or knobs. In some embodiments, the display 504 or the user interface 506 are a combination of digital and physical components. In some embodiments, the user interface 506 provides for receiving or transmitting audible, electronic, wireless, or physical communications.

FIGS. 6 and 7 are exploded views of an accessory lid having an accessory compartment cover or a timepiece with a bottle, in accordance with an embodiment of the invention. In some embodiments, the accessory lid 100 includes the base 102, the base insert 104, the fastener 112, and the cover 116. In some embodiments, the accessory lid 100 includes the accessory compartment cover 114 (FIG. 6). In some embodiments, the accessory lid 100 includes the timepiece 502 (FIG. 7).

In some embodiments, the base 102 includes the internal threads 117 (FIG. 1) for removably receiving the bottle threads 604 of the bottle 602. The base insert 104 is rotatably disposed within the base 102 with the one or more bearings 118 (FIG. 1) being received by the channel 120 (FIG. 1) of the base insert 104. The base insert 104 includes external threads 122 for receiving threads of the cover 116 (not visible). Accordingly, the accessory lid 100 is configurable to being removably secured to the bottle 602 with the bottle 602 receiving the base 102, the base 102 receiving the base insert 104, and the base insert 104 receiving the cover 116.

In some embodiments, the bottle 602 is any NALGENE™, CAMELBACK™, BIOGREEN™, GATORADE™, KLEAN™, SIGG™, BRUNTON™ bottle or any other similar bottle. In some embodiments, the bottle 602 is composed of plastic, metal, glass, rubber, synthetic, or other similar material. In some embodiments, the cover 116 is an existing cover already attached with the bottle 602. In some embodiments, the accessory lid 100 does not include the bottle 602.

Figure 8:
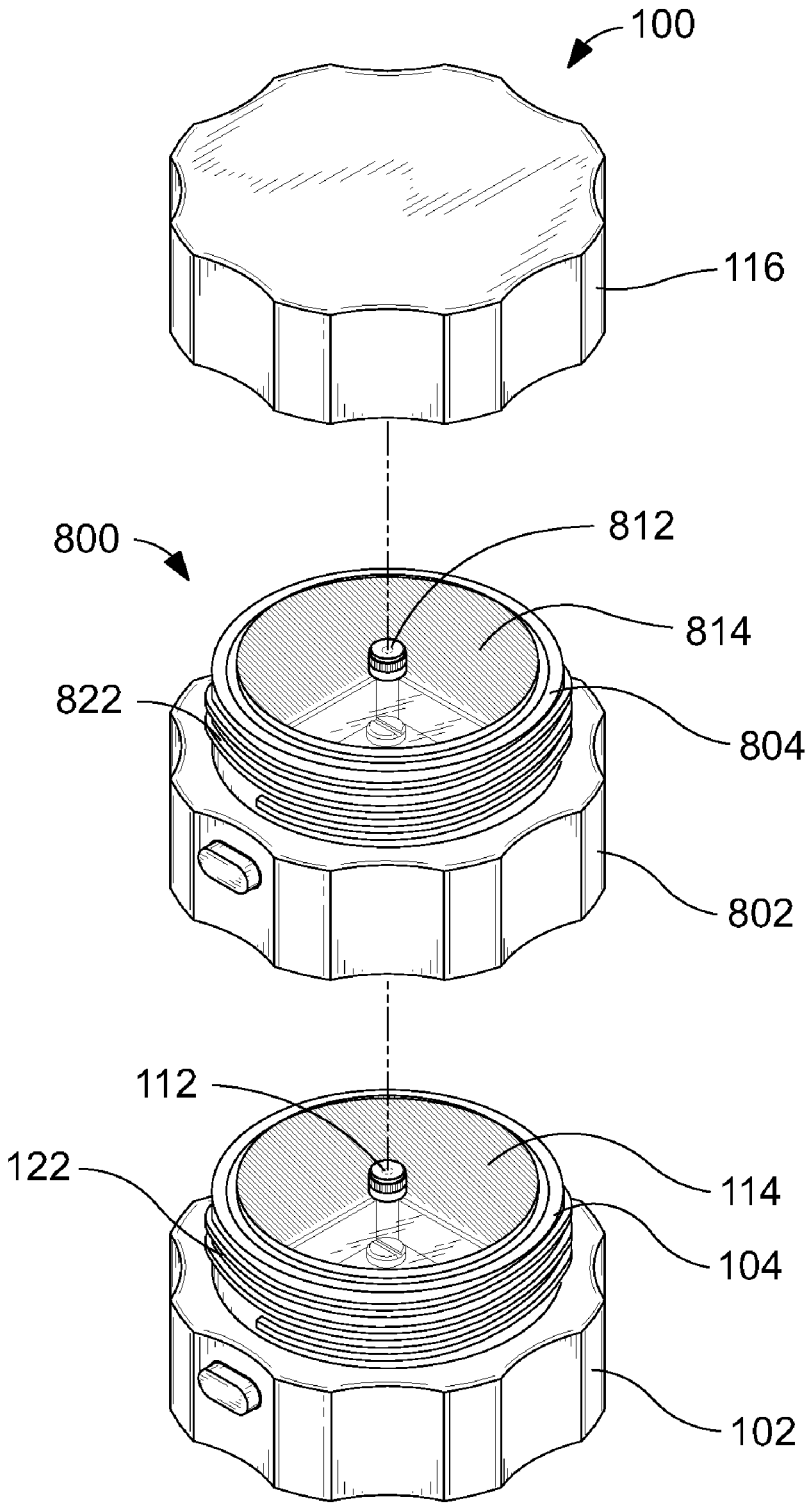
FIG. 8 is an exploded view of stackable accessory lids for a bottle, in accordance with an embodiment of the invention.
Figure 9:
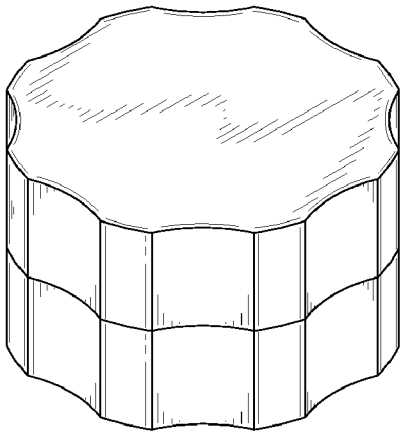
FIG. 9 is a perspective view of an accessory lid for a bottle, in accordance with an embodiment of the invention.
Figure 10:
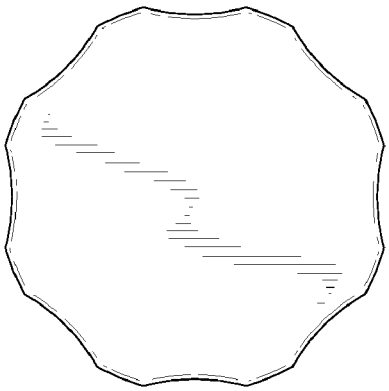
FIG. 10 is a top plan view of an accessory lid for a bottle, in accordance with an embodiment of the invention.
Figure 11:
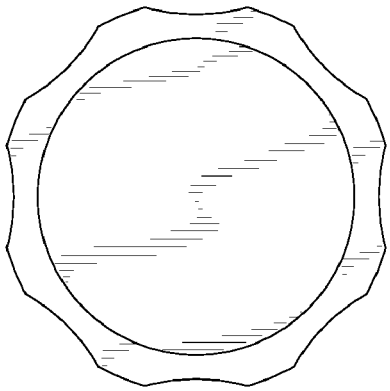
FIG. 11 is a bottom plan view of an accessory lid for a bottle, in accordance with an embodiment of the invention.
Figure 12:
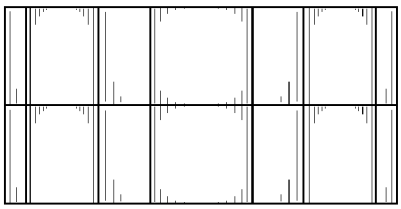
FIG. 12 is a side elevational view of an accessory lid for a bottle, in accordance with an embodiment of the invention.
Figure 15:
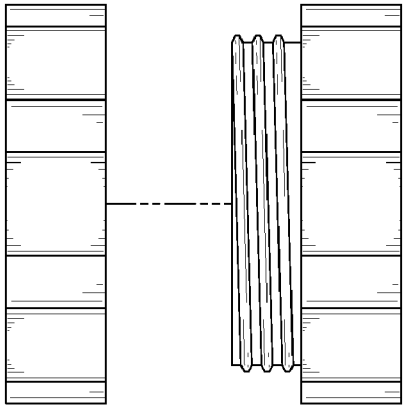
FIG. 15 is a right side elevational view of an accessory lid for a bottle, in accordance with an embodiment of the invention.
Figure 14:
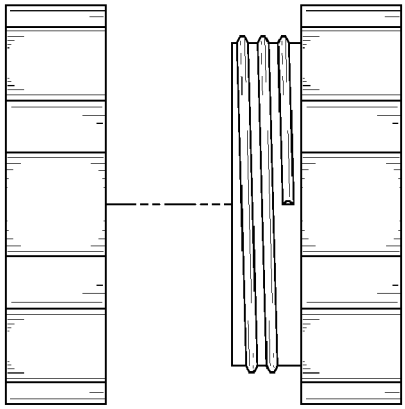
FIG. 14 is a front elevational view of an accessory lid for a bottle, in accordance with an embodiment of the invention.
Figure 16:
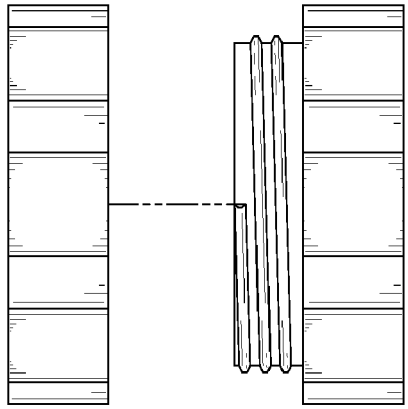
FIG. 16 is a back elevational view of an accessory lid for a bottle, in accordance with an embodiment of the invention.
Figure 13:
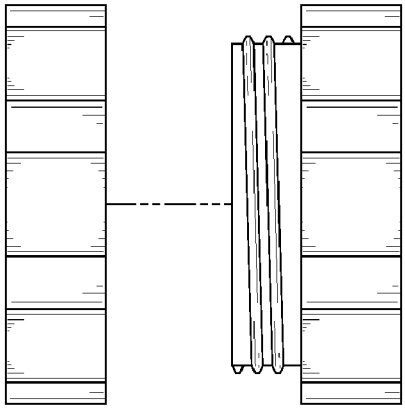
FIG. 13 is a left side elevational view of an accessory lid for a bottle, in accordance with an embodiment of the invention.

FIG. 8 is an exploded view of stackable accessory lids for a bottle, in accordance with an embodiment of the invention. In some embodiments, the accessory lid 100 includes the base 102, the base insert 104, the accessory compartment 106 (FIG. 1), the accessory compartment cover 114, the fastener 112, the cover 116, and one or more accessory lid extensions 800 including a base 802, a base insert 804, an accessory compartment (not labeled), an accessory compartment cover 814, and a fastener 812.

In some embodiments, the base 102 includes the internal threads 117 (FIG. 1) for removably receiving the bottle threads 604 of the bottle 602 (FIGS. 6 and 7). The base insert 104 is rotatably disposed within the base 102 with the one or more bearings 118 (FIG. 1) being received by the channel 120 (FIG. 1) of the base insert 104. The base 802 includes internal threads (not visible) for removably receiving the external threads 122 of the base insert 104. The base insert 804 is rotatably disposed within the base 802 with the one or more bearings (not visible) being received by a channel (not visible) of the base insert 804. The base insert 804 includes external threads 822 for receiving threads of the cover 116 (not visible). Accordingly, the accessory lid 100 including the one or more accessory lid extensions 800 is configurable to being removably secured to the bottle 602 (FIGS. 6 and 7) with the bottle receiving the base 102, the base 102 receiving the base insert 104, the base insert 104 receiving the base 802, the base 802 receiving the base insert 804, and the base insert 804 receiving the cover 116.

In some embodiments, the accessory lid 100 can include two, three, four, five, six, or more accessory lid extensions 800. In some embodiments, the accessory lid 100 and the accessory lid extension 800 can include any of the features disclosed herein. For example, the accessory compartment cover 114 can be substituted with the timepiece 502 (FIG. 5). Alternatively, the accessory lid extension 800 can include a biometric device. Further, the accessory compartment of the accessory lid extension 800 can be different from the accessory compartment 106 (FIG. 1). Additionally, the base 802 can be differently colored than the base 102. An unlimited number of combinations and variations are possible to suit any consumer need. In some embodiments, the base insert 804 can be elongated and extend into the base 102.

FIGS. 9-16 are various views of an accessory lid design for a bottle, in accordance with an embodiment of the invention. Many other accessory lid designs are possible, including rounded, squared, cubed, spherical, cylindrical, rectangled, or any other similar shape, including uniform and non-uniform artistic shapes. Many accessory lid colors and patterns are possible, including single colors, multiple colors, stripes, drawings, pictures, writings, logos, or other similar colors and patterns.

While preferred and alternate embodiments of the invention have been illustrated and described, as noted above, many changes can be made without departing from the spirit and scope of the invention. Accordingly, the scope of the invention is not limited by the disclosure of these preferred and alternate embodiments. Instead, the invention should be determined entirely by reference to the claims that follow.

What is claimed is:

1. An accessory lid comprising:

a base configured to removably couple with a bottle;

an accessory compartment;

a base insert configured to being disposed within the base, the base insert defining an internal cavity for removably receiving the accessory compartment; and a cover configured to removably couple with the base insert.

2. The accessory lid of claim 1, further comprising:

a safety lock configured to control removal of the cover.

3. The accessory lid of claim 2, wherein the base insert is configured to being rotatably disposed within the base and wherein the safety lock is configured to control removal of the cover by preventing rotation of the base insert.

4. The accessory lid of claim 1, wherein the accessory compartment includes one or more compartments.

5. The accessory lid of claim 1, wherein the accessory compartment includes an angled surface edge.

6. The accessory lid of claim 1, wherein the accessory compartment is interchangeable.

7. The accessory lid of claim 1, wherein the accessory compartment includes movable or insertable dividers.

8. The accessory lid of claim 1, wherein the accessory compartment is configured to receive a disposable pod containing any of a drink mix, a food mix, a neutraceutical, or a pharmaceutical.

9. The accessory lid of claim 1, further comprising:

an accessory compartment cover configured to removably cover the accessory compartment.

10. The accessory lid of claim 9, wherein the accessory compartment cover is configured to rotatably cover the accessory compartment.

11. The accessory lid of claim 9, wherein the accessory compartment cover includes a transparent portion.

12. The accessory lid of claim 1, further comprising:

a timepiece.

13. The accessory lid of claim 12, wherein the timepiece includes any of time, date, alarm, GPS, navigation, computer, internet, phone, messaging, e-mail, music, or consumption tracking/monitoring features.

14. The accessory lid of claim 12, wherein the timepiece is configured to removably cover the accessory compartment.

15. The accessory lid of claim 1, further comprising:

the bottle.

16. The accessory lid of claim 15, wherein the cover is an existing bottle cover.

17. The accessory lid of claim 1, further comprising:

one or more accessory lid extensions configured for stackability.

18. The accessory lid of claim 1, further comprising:

an alerting mechanism configured to provide an alert when the cover is not removed within a given time frame.

19. The accessory lid of claim 18, wherein the alert is provided to a remote device.

* * * * *

UNITED STATES PATENT AND TRADEMARK OFFICE

CERTIFICATE OF CORRECTION

PATENT NO. : 8,286,821 B2
APPLICATION NO. : 12/563163
DATED : October 16, 2012
INVENTOR(S) : Leone et al.

It is certified that error appears in the above-identified patent and that said Letters Patent is hereby corrected as shown below:

The title page item (12) should read: Leone et al.
The title page item (76) Jennifer M. Mejia should read Jennifer M. Leone See attached new title page Signed and Sealed this
Nineteenth Day of March, 2013

Teresa Stanek Rea
*Acting Director of the United States Patent and Trademark Office*

(12) United States Patent
Leone et al.

(10) Patent No.: US 8,286,821 B2
(45) Date of Patent: Oct. 16, 2012

(54) ACCESSORY LID FOR BOTTLE

(76) Inventors: Jennifer M Leone, Seattle, WA (US); Benjamin A Mejia, Seattle, WA (US)

( * ) Notice: Subject to any disclaimer, the term of this patent is extended or adjusted under 35 U.S.C. 154(b) by 353 days.

(21) Appl. No.: 12/563,163

(22) Filed: Sep. 21, 2009

(65) Prior Publication Data

US 2011/0036803 A1 Feb. 17, 2011

Related U.S. Application Data

(60) Provisional application No. 61/234,314, filed on Aug. 17, 2009.

(51) Int. Cl.
*B65D 25/04* (2006.01)
*B65D 43/00* (2006.01)
*B65D 51/28* (2006.01)

(52) U.S. Cl. ..... 220/521; 215/228

(58) Field of Classification Search ..... 220/521, 220/522, 528; 215/227, 228
See application file for complete search history.

(56) References Cited

U.S. PATENT DOCUMENTS

| | | | | |
|---|---|---|---|---|
| 2,317,882 | A * | 4/1943 | Boesel | 96/148 |
| 3,433,378 | A * | 3/1969 | Ross | 215/6 |
| 7,055,709 | B1 * | 6/2006 | Esau | 215/228 |
| 2003/0000910 | A1 * | 1/2003 | Jang et al. | 215/237 |
| 2008/0000898 | A1 * | 1/2008 | Ramsden | [illegible] |
| 2008/0156803 | A1 * | 7/2008 | McClellan et al. | 220/254.1 |

* cited by examiner

*Primary Examiner* Harry Grosso
(74) *Attorney, Agent, or Firm* James J. Ruttler; Michael Gibbons

(57) ABSTRACT

This invention relates generally to mechanics, and more specifically, to an accessory lid for a bottle. In one embodiment, the invention includes an accessory lid having a base configured to removably couple with a bottle; a cover configured to removably couple with the base; and an accessory compartment disposed therein. In another embodiment, the invention includes an accessory lid having a base configured to removably couple with a bottle; and an accessory compartment disposed therein, wherein the base is configured to removably couple with an existing bottle cover of the bottle. In a further embodiment, the invention includes a bottle having a base configured to removably couple with the bottle; a cover configured to removably couple with the base; and an accessory compartment disposed therein.

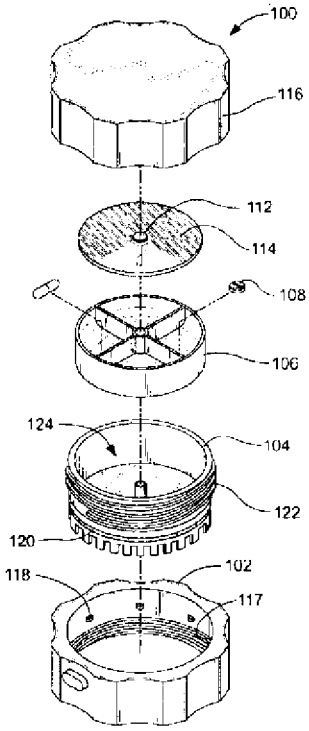

19 Claims, 7 Drawing Sheets